US005810166A

United States Patent [19]

Weinreb

[11] Patent Number: 5,810,166

[45] Date of Patent: Sep. 22, 1998

[54] BAG CLOSURE

[76] Inventor: Robert Weinreb, 510 Broadway, New York, N.Y. 10012

[21] Appl. No.: 623,548

[22] Filed: Mar. 29, 1996

[51] Int. Cl.[6] ..... B65D 85/38

[52] U.S. Cl. ..... 206/316.2; 24/415; 24/431; 190/403; 224/236; 224/908; 383/97

[58] Field of Search ..... 24/386, 431, 415; 383/90; 206/316.2, 316.3; 224/235, 236, 240, 241, 908, 909; 190/903

[56] References Cited

U.S. PATENT DOCUMENTS

| | | | |
|---|---|---|---|
| 2,145,118 | 1/1939 | Knoess | 24/431 |
| 2,691,401 | 10/1954 | Kontoff et al. | 206/316.2 |
| 2,827,096 | 3/1958 | Hinson | 206/316.2 |
| 3,073,367 | 1/1963 | Samara | 190/903 |
| 3,583,044 | 6/1971 | Howell | 24/431 |
| 3,939,547 | 2/1976 | Bernier et al. | 24/415 |
| 4,403,638 | 9/1983 | Baum | 206/316.2 |
| 4,873,750 | 10/1989 | Tracey | 24/431 |
| 5,004,134 | 4/1991 | Barry | 224/235 |
| 5,205,448 | 4/1993 | Kester et al. | 224/236 |
| 5,373,980 | 12/1994 | Rowell et al. | 224/908 |

*Primary Examiner*—Stephen P. Garbe
*Attorney, Agent, or Firm*—Graham & James LLP

[57] ABSTRACT

A circumferential closure for a bag which permits hinged opening of the bag at substantially all position on the circumference and selected full or partial closure. The closure comprises a single zipper (or similar closure mechanism) track wherein one end overlaps the track of the other end by being inserted therewithin. The zipper mechanism comprises four pull elements in two sets, arranged such that juxtaposition (or separated) sequence of the two sets of pairs provides for full closure of the zipper and wherein disposal of a set of pairs between another set of pairs provides for full opening of the zipper, wherein the closure is hinged at the site of the zippers.

6 Claims, 3 Drawing Sheets

BAG CLOSURE

FIELD OF THE INVENTION

This invention relates to closures for bags such as camera bags and in particular to closures for bags which are comprised of zippers.

BACKGROUND OF THE INVENTION

Bags with full zipper closures such as bags for cameras, lap-top computers, attache cases and the like permit the clamshell opening of such bags for insertion or removal of the contents. Camera bags generally are made with zipper hinge lids and the suitcase conformation of bags such as attache cases and lap-top computer bags, generally results in a mid-width split hinging thereof. In such bags the zippers are generally a single track beginning and terminating at opposite ends of a connection hinge between the elements of the clamshell. A single pull element provides the simplest opening and closing means, with positioning at one end of the zipper track causing opening of the zipper and positioning at the other end of the track resulting in full closure (intermediate positions provide intermediate opening and closure positions). Double zipper pulls provide full opening when the pulls are positioned at opposite ends of the track and full closure when they meet anyplace on the track. In all cases full opening results in a single point of hinging for the clamshell elements. With certain bags, such as those worn on the body, e.g., camera bags, hinged openings in a single direction may be a hindrance to extracting of items within the bag. Thus, for example, a chest worn bag is less accessible (or contents are less visible) when the bag opens towards, rather than away from the wearer. Though the zipper may be arranged to open in the most favorable position relative to the wearing straps and the like, some wearers may have other preferences.

SUMMARY OF THE INVENTION

It is therefore an object of the present invention to provide a closure, particularly of a zipper type, which is selectively hingedly openable at substantially any site on the zipper track.

It is a further object of the present invention to economically provide such zipper closure with standard zipper tracks and pull elements.

These and other objects, features and advantages of the present invention will become more evident from the following discussion and drawings in which:

SHORT DESCRIPTION OF THE DRAWINGS

FIG. 1 is a side view of a camera bag, with the zippered top closure of the present invention, showing the interengagement of the ends of the zipper track;

FIGS. 2*a* and 2*b* are opposite side view of the camera bag showing the pairs of zipper pulls in a closed bag position; and FIGS. 3*a–d* show various hinged positions for opening of the end with pull positions.

DETAILED DESCRIPTION OF THE INVENTION

Figure 1:
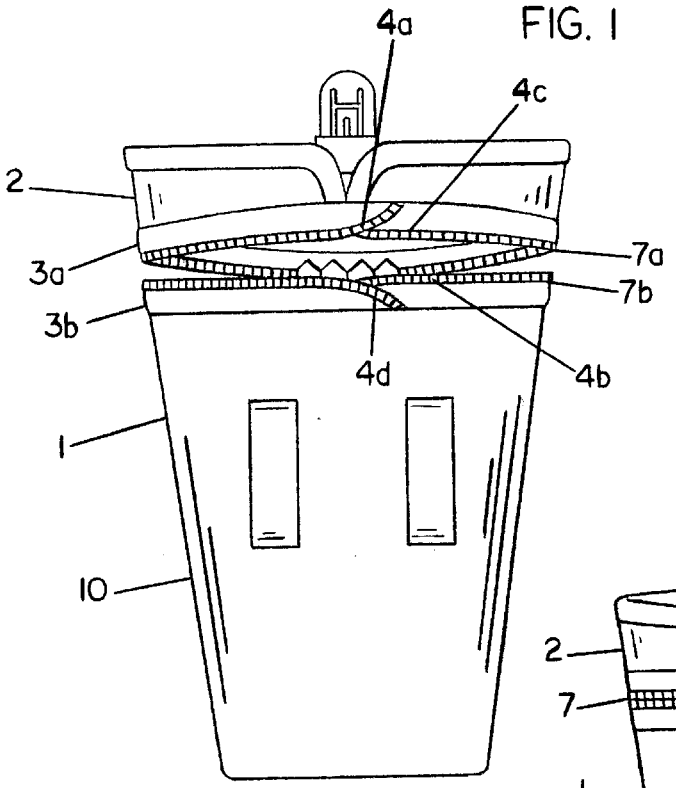

The present invention comprises closure means for a receptacle comprised of a separated closure member and a receptacle member. The closure member and receptacle member are matched with corresponding circumferential edges such that the closure means provides selected full and partial circumferential engagement between the closure member and receptacle member. The closure means is comprised of zipper track means having two separate interlockable track elements. These interlockable track elements are separately disposed at the matched edges of the closure member and receptacle member. Each interlockable track element, is elongated with two ends and positioned such that one end overlaps the other end with corresponding overlapping on the closure member and the receptacle member.

The closure means further comprises four zipper pull members which interconnect the two separate interlockable track elements means. Each of the zipper pull members is movably pullable on the zipper track, with movement in one direction effecting an interlocking of the interlockable track elements and movement in an opposite direction effecting opening of the interlocked track element. Of the zipper pull members, one is positionable between the corresponding ends of the interlockable track elements and another of the zipper pull members is positionable between the remaining corresponding ends of the interlockable track elements. These two end-positionable zipper pull members comprise a first set and the remaining two zipper pull members comprise a second set. Close juxtaposition of all of the zipper pull members in a sequence, wherein one set is interposed between the other set, at substantially any position on the zipper track means, effects opening of the closure means, with the zipper pull members themselves comprising a hinge for the opening.

The present invention comprises a circumferential closure for a bag or similar closed receptacle. The bag or receptacle is comprised of completely separated closure and receptacle members which are engaged with each other by zipper means such that hinged opening of the bag is possible at substantially all positions on the circumference of the closure, as well as selected full or partial closure. The closure comprises zipper means (defined herein as being comprised of opposing engaging edges of a track, which, when lockingly engaged, effect the closure and which, when separated, effect opening) comprised of a zipper track, with one end of the track overlapping the track of the other end, and with one end being inserted within the track of the other end. The closure further comprises four zipper pull elements in two sets, with each of the zipper pulls drawing the opposing edges of the track together. The two zipper pulls of one set are positioned at the terminal ends of the zipper track and the pulls of other set are positioned therebetween. The sets of zipper pulls are arranged such that a juxtaposition sequence of the two pairs of sets, with the pulls of one set enclosing the pulls of the other, provides a hinge point at the juxtaposition location for full hinged opening of the closure at the juxtaposition position. Sequential arrangement of the pull sets on the zipper track circumference (either with close juxtaposition or even with separation along the circumference, results in closing of the closure).

The zipper track means and closure of the present invention is applicable to bags, such as camera bags, handbags, ladies purses, school knapsacks, attache cases, lap-top computer cases and the like. It is preferred that the zipper track elements and pull members be of good quality or close tolerance in order to prevent jamming or track slipping of the pulls which provide the hinged opening. In addition to the zipper track closure means, the bags or similar receptacles can be provided with secondary latch elements which must be initially disengaged to permit the selective site hinged opening of the present invention.

DETAILED DESCRIPTION OF THE DRAWINGS AND THE PREFERRED EMBODIMENTS

With reference to the drawings, in the Figures, camera bag 10 is comprised of receptacle member 1 closed by closure cover 2 by means of zipper track closure 7. Members 1 and 2 are fully separated and are held together by the zipper track closure 7, with engagement of circumferential edges 3*a* and 3*b* of the receptacle member 1 and closure 2 respectively, by means of zipper track elements 7*a* and 7*b* respectively. Zipper track element 7*a* terminates in overlapping ends 4*a* and 4*c*, affixed to edge 3*a* of closure cover 2. Zipper track element 7*b* terminates in similar overlapping ends 4*b* and 4*d* which are affixed to edge 3*b* of receptacle member 1. Zipper pull elements 5*a* & 5*b* and 6*a* & 6*b* comprise two sets, 5 and 6, of pull elements. Pull elements 5*b* and 5*a* are positioned at and lockingly span the track ends 4*a* & 4*d* (for pull element 5*b*) and track ends 4*b* & 4*c* (for pull element 5*a*) respectively. Pull elements 6*a* and 6*b* are positioned between pull elements 5*a* and 5*b* to lockingly span zipper track elements 7*a* and 7*b*. All of the zipper pulls (5*a*, 5*b*, 6*a*, and 6*b*) are freely movable on zipper track closure 7 between ends 4 and 4' thereof, subject to blockage by the other pull elements.

Figure 2A:
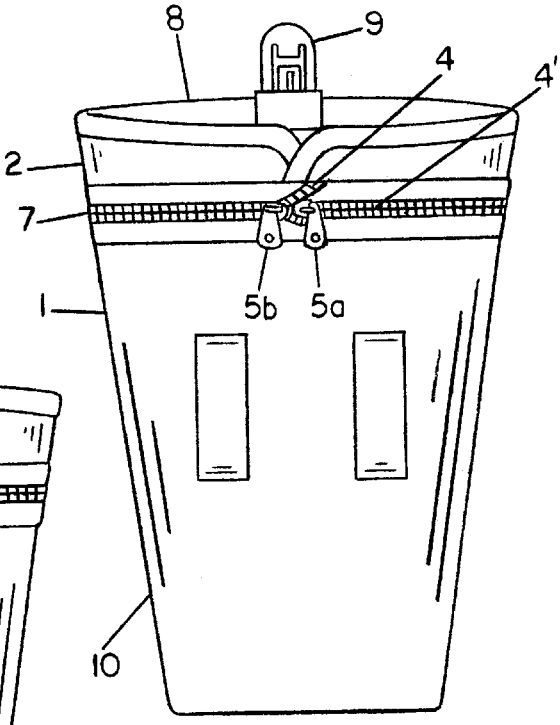
Figure 2B:
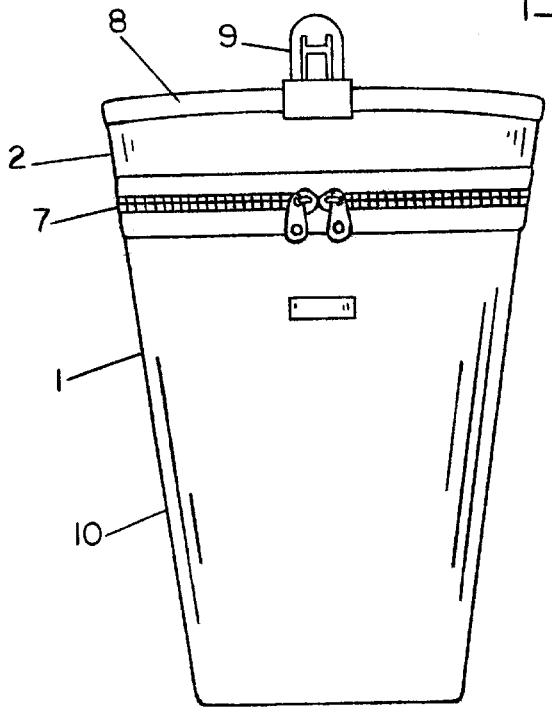
Figure 3A:
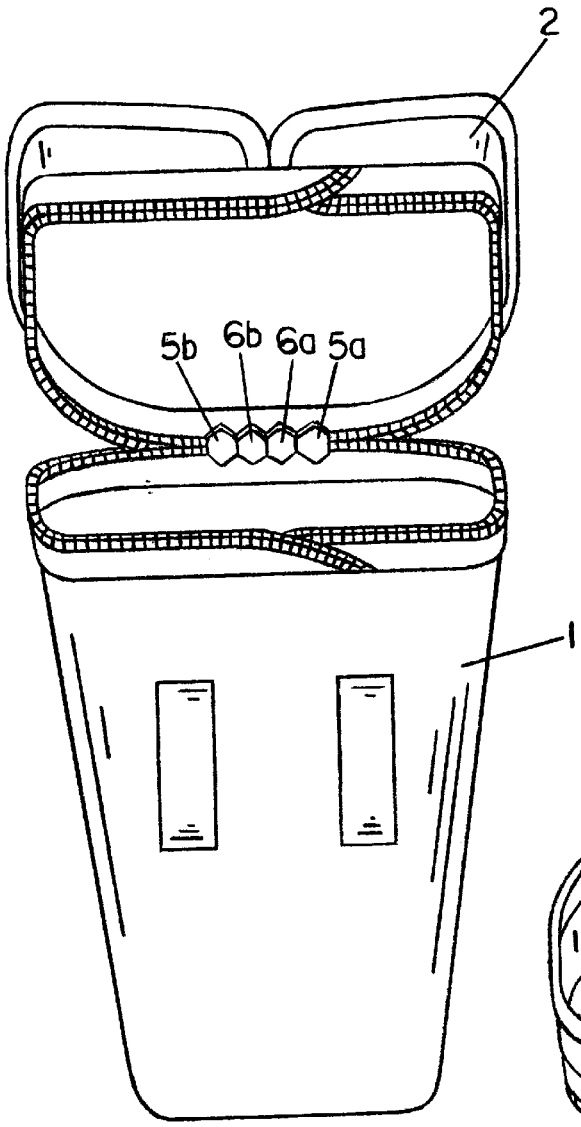
Figure 3B:
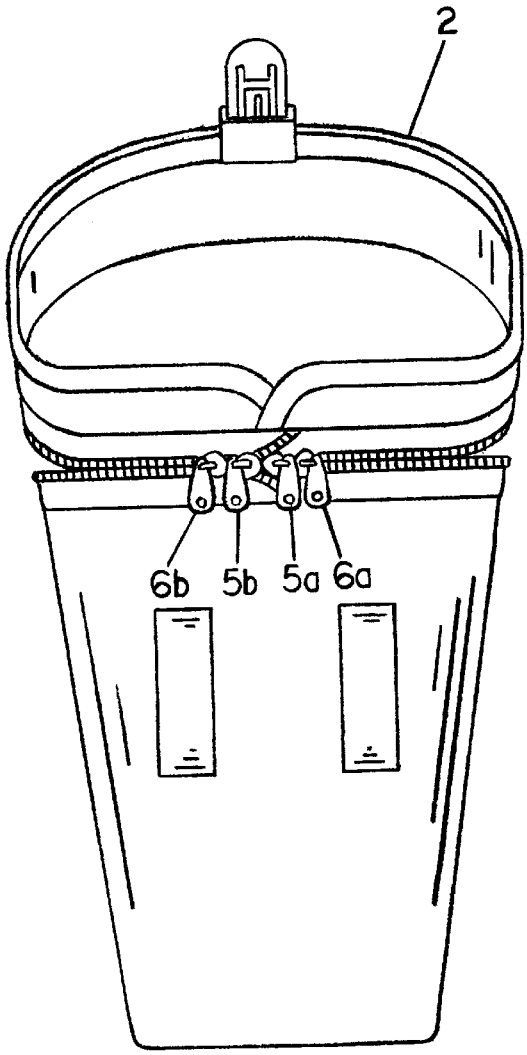
Figure 3C:
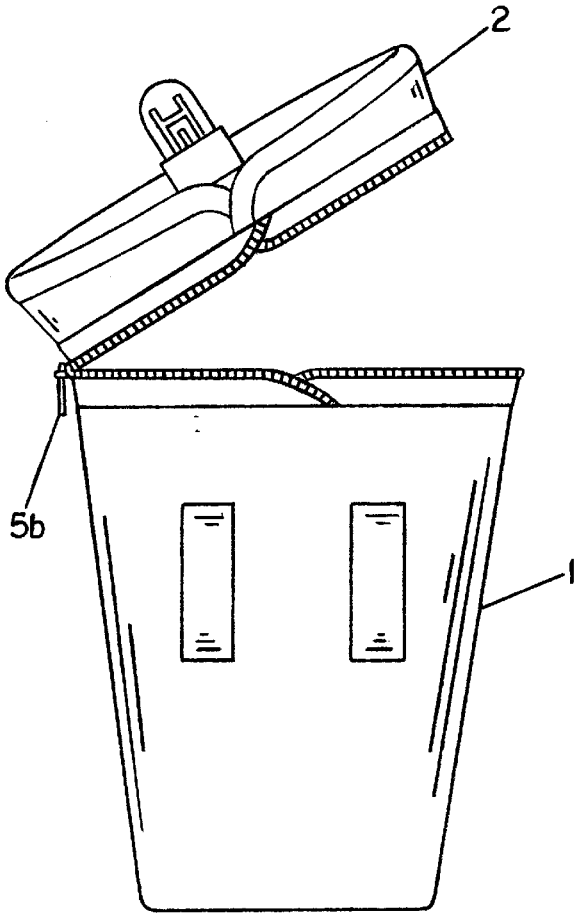
Figure 3D:
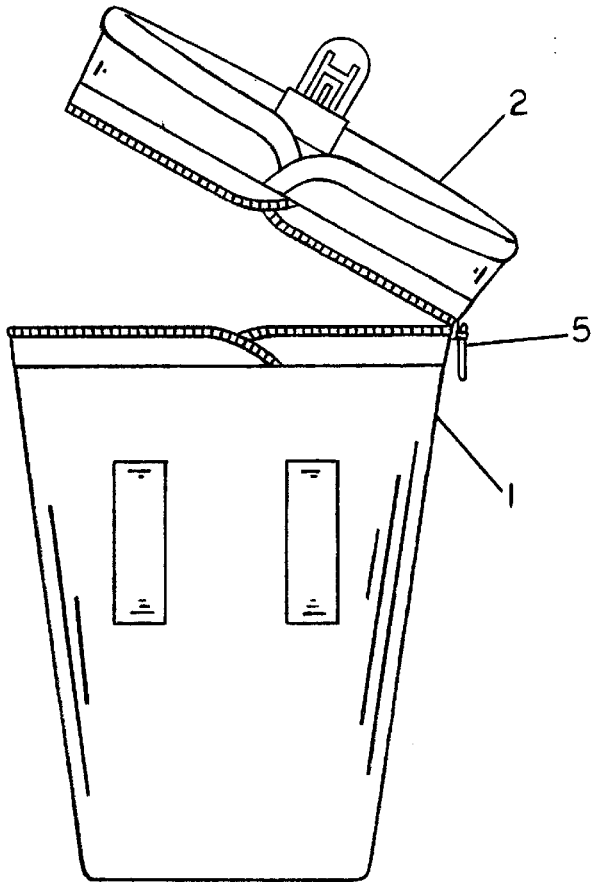

FIGS. 2*a* and 2*b* show the relative positions of pull element sets 5 and 6 (5*a*,5*b* and 6*a*,6*b*) in effecting full closure of receptacle 1 with cover 2. With such full closure, waterproof shield 8 can be everted to cover the zipper closure 7 and pull element sets 5 and 6 to prevent water ingress to items such as cameras contained in the bag. Latch 9 can also be engaged to securely close the bag. Loops 11 are used to hold straps (not shown) for adapting the bag to be worn on a person's body or for otherwise providing holding of the bag.

FIGS. 3*a–d* show various positions of the juxtaposed members of the pull element sets 5 and 6 in effecting hinged openings of the receptacle 1 with clamshell opening of cover 2. In all of such FIGURES, the four elements (5*a*,5*b*,6*a*,6*b*) constitute the hinge for the opening and retention of the cover 2 on the receptacle 1. For ease in proper use it is preferred that the separate pull element sets be color or shape coded such as with different colors and different shapes (e.g. different lengths, as shown in dotted lines for the pull element sets 5 and 6) as is commonly utilized for identification means for commonly grouped items in the respective sets for distinguish between elements of the different sets.

It is understood that the above description and drawings are exemplary in nature and that changes may be made such as in structure, type of elements, relation between elements and the type of bag or receptacle being used, without departing from the scope of the present invention as defined in the following claims.

What is claimed is:

1. A receptacle comprised of a separated closure member and a receptacle member, each having matched corresponding circumferential edges; wherein the closure member comprises means for providing selected full and partial circumferential engagement between the closure member and receptacle member; said means for providing selected engagement being comprised of a zipper track having two separate interlockable track elements, with said two interlockable track elements being separately disposed at the matched edges of the closure member and receptacle member; wherein the interlockable track element, at the edge of the closure member, is elongated with two ends and wherein one end overlaps the other end; and wherein the interlockable track element, at the edge of the receptacle member, is correspondingly elongated with two ends, wherein one end correspondingly overlaps the other end; said means for providing selected engagement further comprising four zipper pull members which interconnect the two separate interlockable track elements, each of the zipper pull members being movably pullable on said zipper track, with movement in one direction effecting an interlocking of the interlockable track elements and movement in an opposite direction effecting opening of the interlocked track element; wherein one of said zipper pull members is positionable between the corresponding ends of the interlockable track elements and another of said zipper pull members being positionable between the remaining corresponding ends of the interlockable track elements, said two end-positionable zipper pull members comprising a first set and the remaining two zipper pull members comprising a second set; wherein close juxtaposition of all of the zipper pull members in a sequence wherein one set is interposed between the other set, at substantially any positions on said zipper track, effects opening and separation of the closure member and the receptacle, with said zipper pull members comprising a hinge for said opening.

2. The closure of claim 1, wherein the first and second sets of pull members are separately identifiable by identification means.

3. The closure of claim 2, wherein the identification means comprises color coding.

4. The closure of claim 2, wherein the identification means comprises shape coding.

5. The closure of claim 1, wherein the receptacle is adapted to be worn on a body in a specific position and wherein the sets of zipper pull members are movable to permit hinged opening of the closure member in either a direction toward the body or away from the body.

6. The closure of claim 5, wherein said receptacle is a camera bag.

* * * * *